US006895207B2

(12) United States Patent
Kataoka et al.

(10) Patent No.: US 6,895,207 B2
(45) Date of Patent: May 17, 2005

(54) IMAGE HEATING APPARATUS HAVING FLEXIBLE METALLIC SLEEVE AND REINFORCING MEMBER DISPOSED IN AN INTERIOR OF SAID SLEEVE

(75) Inventors: Hiroshi Kataoka, Shizuoka (JP); Satoru Izawa, Shizuoka (JP); Eiji Uekawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/698,527

(22) Filed: Nov. 3, 2003

(65) Prior Publication Data

US 2004/0120737 A1 Jun. 24, 2004

(30) Foreign Application Priority Data

Nov. 6, 2002 (JP) ..... 2002-322137
Oct. 30, 2003 (JP) ..... 2003-370097

(51) Int. Cl.[7] ..... G03G 15/20
(52) U.S. Cl. ..... 399/328; 399/69
(58) Field of Search ..... 399/328, 320, 399/67, 69

(56) References Cited

U.S. PATENT DOCUMENTS

| | | | | |
|---|---|---|---|---|
| 5,450,181 | A | 9/1995 | Tsukida et al. | 355/282 |
| 5,722,026 | A | 2/1998 | Goto et al. | 399/333 |
| 5,839,043 | A * | 11/1998 | Okabayashi et al. | 399/329 |
| 5,860,051 | A | 1/1999 | Goto et al. | 399/529 |
| 5,862,435 | A | 1/1999 | Suzumi et al. | 399/68 |
| 5,870,660 | A * | 2/1999 | Ito et al. | 399/330 |
| 5,904,871 | A | 5/1999 | Sakai et al. | 219/216 |
| 5,920,757 | A | 7/1999 | Izawa et al. | 399/329 |
| 5,960,233 | A | 9/1999 | Goto et al. | 399/69 |
| 6,002,106 | A | 12/1999 | Kataoka et al. | 219/216 |
| 6,438,348 | B2 | 8/2002 | Kobaru et al. | 399/333 |
| 6,493,521 | B2 | 12/2002 | Miyamoto et al. | 399/44 |
| 6,519,426 | B2 | 2/2003 | Goto et al. | 399/69 |
| 2002/0168202 | A1 | 11/2002 | Izawa et al. | 399/329 |
| 2003/0029853 | A1 | 2/2003 | Izawa et al. | 219/216 |
| 2003/0035667 | A1 | 2/2003 | Izawa et al. | 399/333 |
| 2003/0038125 | A1 | 2/2003 | Kataoka et al. | 219/216 |
| 2003/0042241 | A1 | 3/2003 | Uekawa et al. | 219/216 |
| 2003/0118363 | A1 | 6/2003 | Izawa et al. | 399/69 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |

* cited by examiner

*Primary Examiner*—Quana Grainger
(74) *Attorney, Agent, or Firm*—Fitzpatrick, Cella, Harper & Scinto

(57) ABSTRACT

An image heating apparatus for heating an image formed on a recording material, including a metallic sleeve, a heater contacting with the inner surface of the sleeve, the heater being controlled so as to maintain a set temperature, a backup member cooperating with the heater through the sleeve to form a nip for nipping and transporting the recording material, and a metallic reinforcing member disposed in the interior of the sleeve, wherein during a heating operation of heating the recording material by the heater, the surface temperature of the reinforcing member is 80% or less of the surface temperature of the sleeve.

7 Claims, 11 Drawing Sheets

IMAGE HEATING APPARATUS HAVING FLEXIBLE METALLIC SLEEVE AND REINFORCING MEMBER DISPOSED IN AN INTERIOR OF SAID SLEEVE

BACKGROUND OF THE INVENTION

1. Field of the Invention

The invention relates to an image heating apparatus suitable for use as a heat-fixing device carried on an image forming apparatus such as a copying machine or a printer, and particularly to an image heating apparatus having a flexible metallic sleeve.

2. Description of Related Art

Heat-fixing apparatuses of a heat roller type or a film heating type have heretofore been widely used as fixing apparatuses applied to image forming apparatuses such as copying machines or printers. Particularly, a method whereby during standby, electric power is not supplied to a heat-fixing apparatus to thereby minimize the consumption of electric power, and more particularly a heat-fixing method using a film heating process of fixing a toner image on a recording material with film interposed between a heater portion and a pressure roller are proposed in Japanese Patent Application Laid-Open No. S63-313182, Japanese Patent Application Laid-Open No. H2-157878, Japanese Patent Application Laid-Open No. H4-44075, Japanese Patent Application Laid-Open No. H4-204980, etc. As the construction of a film heat-fixing device, there are method of using a transport roller exclusively for the transport of film and a driver roller to transport the film between the transport roller and a pressure roller while applying tension to the film, and a method of driving cylindrical film by a transporting force from a pressure roller, and the former method has a merit of being capable of keeping film transporting performance high, and the latter method has a merit of being capable of realizing a low-cost fixing device resulting from the simplification of construction.

As a specific example, the cross-sectional construction of a heat-fixing device of the latter pressure roller driving type is schematically shown in FIGS. 2, 3 and 5 of the accompanying drawings. FIGS. 2, 3, and 5 show portions common to those of a fixing apparatus to which the present invention is applied and which will be described later. The fixing apparatus 10 shown in FIGS. 2 and 3 has a heating member (hereinafter referred to as the heater holder) 11 fixedly supported by a holding member (hereinafter referred to as the heater holder) 12, heat-resistant thin film (hereinafter referred to as the fixing film) 13 rotated while being in contact with the heater 11, and an elastic pressure roller 20 brought into pressure contact with the heater 11 with a nip part (fixing nip part) N of a predetermined nip width formed with the fixing film 13 interposed therebetween. The heater holding portion of the heater holder 12 is longer than the lengthwise direction (a direction perpendicular to the plane of the drawing sheet of FIG. 2) of the fixing film 13, and protrudes from the opposite end portions of the fixing film 13. This protruding portion is biased toward the pressure roller 20 side by a spring, not shown. The heater holder 12 is formed by a heat-resistant molded member or the like and produces flexure by being pressurized and therefore, a reinforcing member 30 is made to abut against the counter-heating member side of the heater holder 12 to thereby prevent the flexure. The heater 11 is heated and controlled to a predetermined temperature by being electrically energized. The fixing film 13 is a cylindrical thin member transported in the direction of arrow by a rotative driving force from driving means, not shown, or the pressure roller 20 while being in close contact with and sliding relative to the surface of the heater at the fixing nip part N.

When in a state in which the heater 11 is heated and controlled to the predetermined temperature and the fixing film 13 has been transported in the direction of arrow, a recording material P having an unfixed toner image T formed and borne thereon is introduced into between the fixing film 13 and the pressure roller 20 at the fixing nip part N, the recording material P is in close contact with the surface of the fixing film 13 and is nipped and transported with the fixing film 13 by the fixing nip part N. At this fixing nip part N, the toner image T on the recording material P is heated through the fixing film 13 heated by the heater 11, whereby it is fixed as a permanent image on the recording material P. The recording material P passed through the fixing nip part N is stripped off from the surface of the fixing film 13 and is transported.

A ceramic heater is generally used as the heater 11 as a heating member. This heater will hereinafter be described in detail with reference to FIG. 3.

For example, an energized heat-generating resistor layer 11*b* of silver palladium (Ag/Pb).Ta2N or the like is formed on the surface of a ceramic substrate 11*a* of good electrical insulativeness, good thermal conductivity and low heat capacity such as alumina (a surface on that side thereof which faces the fixing film 13) along the lengthwise direction of the substrate (a direction orthogonal to the transport direction of the recording material, and a direction perpendicular to the plane of the drawing sheet of FIG. 3) by screen printing or the like, and further the surface on which the heat-generating resistor layer is formed is covered with a thin glass protective layer 11*c*. This ceramic heater 11 is such that the energized heat-generating resistor layer 11*b* is electrically energized to thereby generate heat and the entire heater comprising the ceramic substrate 11*a* and the glass protective layer 11*c* rapidly rises in temperature. This temperature rise of the heater 11 is detected by a temperature detecting element 14 disposed on the back of the heater and is fed back to an energization controlling portion, not shown. The energization controlling portion controls the electrical energization of the energized heat-generating resistor layer 11*b* so that the temperature of the heater detected by the temperature detecting element 14 may be maintained at a predetermined substantially constant temperature (fixing temperature). That is, the heater 11 is heated and controlled to a predetermined fixing temperature.

The fixing film 13 has its thickness made as small as 20–70 $\mu$m in order to efficiently give the heat from the heater 11 to the recording material P at the fixing nip part N. This fixing film 13 is constituted by three layers, i.e., a film base layer a primer layer and a mold-releasable layer, and the film base layer side thereof is a heater side and the mold-releasable layer side thereof is a pressure roller side. The film base layer is formed of polyimide, polyamideimide, PEEK or the like which is higher in insulativeness than the glass protective layer, and has heat resistance and high elasticity. Also, the mechanical strength such as the tear strength of the entire fixing film is kept by the film base layer. The primer layer is a thin layer having a thickness of the order of 2–6 $\mu$m. The mold-releasable layer is a toner offset preventing layer for the fixing film, and is covered to a thickness of the order of 10 $\mu$m with fluorine resin such as PFA, PTFE or FEP.

Also, the heater holder 12 is formed, for example, by a heat-resistant plastic member, and holds the heater 11 and serves also as a transport guide for the fixing film 13. The reinforcing member 30 is formed of a metal material in order not to produce the flexure of the heater holder by a pressure force, and the cross-sectional shape thereof is an "inverted U-shape" shown in FIG. 4A of the accompanying drawings, or a "U-shape" shown in FIG. 4B of the accompanying drawings.

In a heating apparatus of a film heating type using such thin fixing film, the pressure roller 20 having an elastic layer 22 is brought into pressure contact with the flattened underside of the heater 11 because of the high rigidity of the ceramic heater 11 as a heating member, whereby the fixing nip part N of a predetermined width is formed, and only the fixing nip part N is heated to thereby realize heat-fixing of quick start.

In the above-described construction, the arrangement relationship between the energized heat-generating resistor layer of the heater 11 and the pressure roller 20 will now be described with reference to FIG. 5.

In FIG. 5, the lengthwise width W of the energized heat-generating resistor layer 11*b* of the heater 11 is somewhat narrow as compared with the width D of the elastic layer 22 of the pressure roller 20 brought into pressure contact with the heater with the fixing film 13 interposed therebetween. This is for preventing the energized heat-generating resistor layer 11*b* from jutting out from the pressure roller 20 to thereby locally raise the temperature of the heater 11 and damage the heater 11 by the thermal stress thereof. Also, the energized heat-generating resistor layer 11*b* is formed with a width sufficiently wider than a transport area for the recording material P having the toner image formed and borne thereon. Thereby, the influence of the temperature drop of the end portion (due to the leakage of heat to electrical contacts for energization and connectors at the end portions of the heater) can be eliminated, whereby a good fixing property is obtained over the entire surface of the recording material. Further, there is a case where the width of the energized heat-generating resistor layer at the end portions of a sheet passing area is reduced and the amount of generated heat at the end portions is increased to thereby make up for the fixing property of the end portions.

Thereby, the heat generated by electrically energizing the energized heat-generating resistor layer 11*b* of the heater 11 is efficiently given to the recording material P transported between the fixing film 13 and the pressure roller 20 to thereby act to fuse and fix the toner image T on the recording material P.

Also, the letter S designates a recording material transport standard, and in this case, it designates a central standard device having a standard provided at the lengthwisely center of the recording material transport area of an image forming apparatus main body.

Further, as shown in FIG. 5, the temperature detecting element 14 such as a thermistor and a thermoprotector 15 such as a temperature fuse or a thermoswitch which is a safety element for shutting down the electrical energization of the energized heat-generating resistor layer 11*b* of the heater 11 during wild run abut against the back of the heater, and these are disposed in a transport area for a recording material of a minimum width transportable by the image forming apparatus. The temperature detecting element 14 and the thermoprotector 15 are designed to be contained in the interior of the metallic reinforcing member 30.

The temperature detecting element 14 is provided in a transport area for a recording material of a usable minimum definite size in order to heat and fix a toner image on the recording material at a moderate fixing temperature without causing such problems as faulty fixing and high temperature offset even when a recording material of a minimum width transportable by the image forming apparatus main body is transported. On the other hand, if the thermoprotector 15 is disposed in a non-transporting area for the recording material when a recording material of a small size is transported, the thermoprotector 15 will malfunction due to the excessive temperature rise of the non-transporting area even during normal transport and will shut out electrical energization and therefore, the thermoprotector 15 is also provided in the transporting area for the recording material of the usable minimum definite size. Also, the thermo protector 15 is made to abut against the back of the heater, whereby it may happen that the amount of heat generated by the energized heat-generating resistor layer 11*b* is taken away by the thermoprotector 15 and a sufficient amount of heat becomes incapable of being given to the recording material P and faulty fixing is caused at the abutting position of the thermoprotector. In order to prevent this, at a position on the energized heat-generating resistor layer 11*b* which corresponds to the abutment of the thermoprotector, the width of a portion of the energized heat-generating resistor layer 11*b* of the heater 11 is somewhat narrowed as shown in FIG. 5 and the resistance value at this abutting position is made greater than that of the other portions to thereby secure an amount of generated heat. Thereby, the amount of heat supplied to the recording material P is made constant in the lengthwise direction to thereby realize good heating and fixing free of the unevenness of fixing. The temperature detecting element 14 is likewise made to abut against the back of the heater and therefore, it is feared that the heat generated by the energized heat-generating resistor layer 11*b* is likewise taken away by the temperature detecting element 14, but the amount of heat taken away from the heater can be suppressed to a small amount by using a temperature detecting element of a small heat capacity such as a chip thermistor. Thus, even is the above-described countermeasure similar to that for the thermoprotector 15 is not adopted, uniform fixing becomes possible without spoiling the uniformity of the fixing of the recording material in the lengthwise direction.

The heat-fixing apparatus of the film heating type described hitherto does not require preliminary heating during standby due to the high heating efficiency and the possibility of quick start and therefore, enjoys many merits such as the possibility of achieving the saving of electric power and a merit to the user by the elimination of a waiting time, and particularly, a method of driving the cylindrical film by the transporting force of the pressure roller can realize a low cost and therefore it is expected to be introduced into a compact low-speed machine to a large high-speed machine in the future.

To achieve this higher speed, thermal energy sufficient for fixing must be supplied even in the case of a recording material which has become shorter in the time required to pass through the fixing nip part. As means for realizing this, it is conceivable to set the fixing temperature to still a higher temperature, to increase the pressure force between the pressure roller and the fixing film and widen the width of the fixing nip which is a heating area, or to change the materials of the heater substrate and the fixing film to ones excellent in thermal conductivity to thereby increase the amount of supplied heat.

However, such an improvement, if carried out, will increase the load to the fixing film and promote the deterioration of the fixing film, and this will lead to the disadvantage that service life becomes short.

For example, if in order to improve the thermal conductivity of the base layer of the fixing film, the amount of addition of a filter of high thermal conductivity such as boron nitride (BN) or aluminum nitride (ALN) is increased to thereby contrive an improvement in thermal conductivity, the original flexibility and strength of resin such as polyimide (PI) will be spoiled to thereby hasten the wear and deterioration of the fixing film.

So, what has been newly proposed is to employ as the base material of the fixing film a cylindrical thin-walled rotary member (metallic sleeve) formed of a metal more excellent in thermal conductivity than resin. This metallic sleeve can transmit thermal energy sufficient for fixing to the recording material by the thermal conductivity of the material thereof even if the fixing temperature is not set to a high temperature or the pressure force is not made great in order to make the width of the fixing nip great, and it becomes possible to achieve a film heat-fixing apparatus more excellent in the capability of coping with a high speed.

However, it has been found that when in the heat-fixing apparatus of good thermal efficiency using the metallic sleeve as the fixing film 13, the smaller diameter of the metallic sleeve is contrived for the purposes of making the radiation from the metallic sleeve small, and making the heat capacity of the fixing apparatus 10 comprising the metallic sleeve or the like small, in order to achieve higher thermal efficiency, there arises such a problem as will be described below.

When the smaller diameter of the metallic sleeve is contrived, the distance thereof from the metallic reinforcing member 30 installed on the back of the heater holder 12 becomes smaller. Thereupon, due to the excellent radiative property which is the characteristic of the metal which is the material of the metallic sleeve, thermal energy accumulated in the metallic sleeve is transmitted through the air which is an adiabatic layer and is used to cause the metallic reinforcing member 30 to rise in temperature, and as the result, the surface temperature of the metallic sleeve lowers and the temperature of the reinforcing member 30 rises, and it has been found that when continuous image fixing is effected, the difference between the temperature of the metallic sleeve and the temperature of the rein forcing member becomes as small as the order of several ° C.

Thus, the surface temperature of the metallic sleeve becomes incapable of keeping a temperature necessary to fix an unfixed toner image, and a phenomenon of the fixing property being spoiled occurs.

SUMMARY OF THE INVENTION

The present invention has been made in view of the above-noted problem and an object thereof is to provide an image heating apparatus which can reduce faulty heating by the use of a metallic sleeve.

Another object of the present invention is to provide an image heating apparatus in which the temperature rise of a reinforcing member provided in a metallic sleeve is suppressed.

Still another object of the present invention is to provide an image heating apparatus in which the malfunctioning of a safety element can be suppressed.

Yet still another object of the present invention is to provide an image heating apparatus comprising:

a metallic sleeve;

a heater contacting with the inner surface of the sleeve, the heater being controlled so as to maintain a set temperature;

a backup member cooperating with the heater through the sleeve to form a nip part for nipping and transporting a recording material; and a metallic reinforcing member disposed in the interior of the sleeve;

wherein during a heating operation of heating the recording material by the heater, the surface temperature of the reinforcing member is 80% or less of the surface temperature of the sleeve.

Further objects of the present invention will become apparent from the following detailed description when read with reference to the accompanying drawings.

DETAILED DESCRIPTION OF THE PREFERRED EMBODIMENTS

Some preferred embodiments of the present invention will hereinafter be described in detail by way of example with reference to the drawings. However, the dimensions, materials, shapes and relative disposition of constituent parts described in the following embodiments should be suitably changed depending on the construction and various conditions of an apparatus to which the present invention is applied, and unless particularly specified, the scope of the present invention is not restricted thereto.

[First Embodiment]

An image forming apparatus provided with a fixing apparatus according to a first embodiment of the present invention will hereinafter be described in detail with reference to the drawings.

{Image Forming Apparatus}

Figure 6:
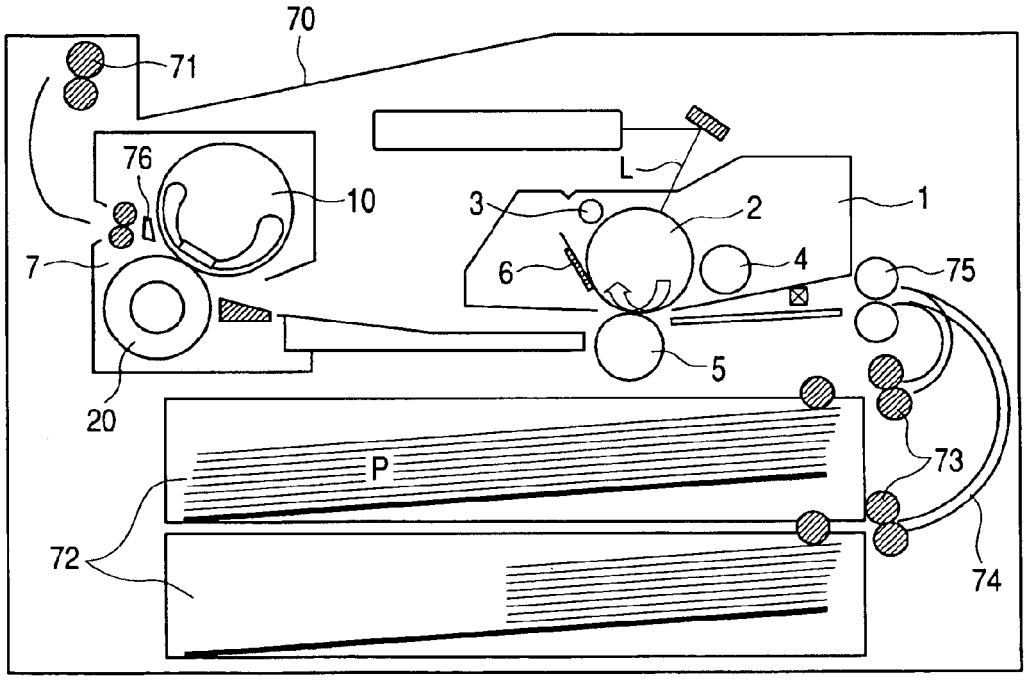
FIG. 6 is a cross-sectional view of an image forming apparatus carrying the image heating apparatus of the present invention thereof.
Figure 7:
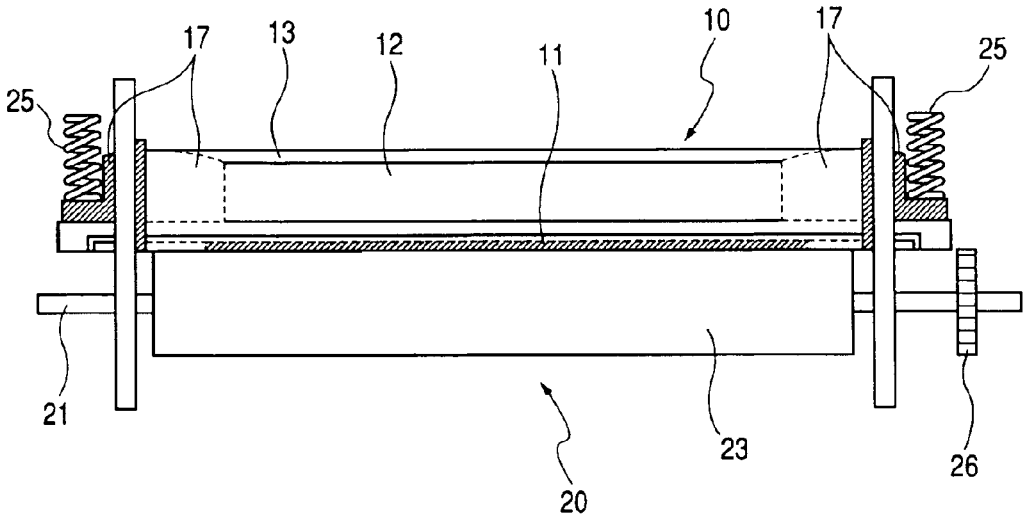
FIG. 7 is a lengthwise cross-sectional view of the heat-fixing apparatus.

First, FIG. 6 shows the construction of an image forming apparatus carrying the image heating apparatus of the present invention thereon. In FIG. 6, the reference numeral 2 designates a photosensitive drum in which a photosensitive material such as OPC, amorphous Se or amorphous Si is formed on a cylinder-shaped base of aluminum, nickel or the like. The photosensitive drum 2 is rotatively driven in the direction of arrow and at first, the surface thereof is uniformly charged by a charging roller 3 as a charging apparatus. Next, it is subjected to scanning exposure by a laser beam L ON/OFF-controlled in conformity with image information, whereby an electrostatic latent image is formed thereon. This electrostatic latent image is developed and visualized by a developing apparatus 4. As a developing method, use is made of a jumping developing method, a two-component developing method, an FEED developing method or the like, and a combination of image exposure and reversal developing is often used. Any untransferred residual toner residual on the photosensitive drum 2 is removed from the surface of the photosensitive drum by a cleaning member 6. These series of functions are provided as those of a process cartridge 1.

The visualized toner image is transferred from the photosensitive drum 2 onto a recording material P transported at predetermined timing, by a transferring roller 5 as a transferring apparatus. The recording material P is picked up from a cassette 72 by a pair of feeding rollers 73, is fed via a feed transport path 74 to a pair of registration rollers 75 for detecting the leading edge portion of the recording material, and is timed with the visible image on the photosensitive drum 2, whereafter it is transported to a transferring nip. At this time, the recording material P is nipped and transported with a constant pressure force by the photosensitive drum 2 and the transferring roller 5. The recording material P onto which the toner image has been transferred is transported to a fixing apparatus 7, whereby the toner image is fixed as a permanent image, and the recording material P is delivered to a delivery tray 70 via a pair of delivery rollers 71.

{Heat-Fixing Apparatus}

The construction of a heat-fixing apparatus of a film heating type used in the first embodiment of the present invention will now be described with reference to FIGS. 1, 2, 3, 5 and 7.

<<Fixing Film Unit>>

The fixing apparatus 10 is comprised of the following members. The reference numeral 13 denotes fixing film (flexible metallic sleeve) of small heat capacity, and in order to make quick start possible, it is formed with a total thickness of 200 μm or less with a pure metal such as stainless steel (SUS), magnesium (Mg), aluminum (Al), nickel (Ni), copper (Cu), zinc (Zn) or titanium (Ti) having heat resistance and high thermal conductivity or an alloy thereof as a base material. Also, to obtain durability having sufficient strength over a service life during the heat-fixing step, a thickness of 30 μm or greater is necessary. That is, the fixing film 13 is a metallic sleeve which is a cylindrical thin walled rotary member formed of a metal, and a metallic cylindrical blank tube having a total thickness within a range of 30–200 μm is optimum as this metallic sleeve. Further, in order to prevent offset and secure the separability of the recording material, the surface layer of the metallic sleeve is coated or covered with heat-resistant resin of good mold releasability such as PFA, PTFE or FEP in a mixed form or singly. The metallic sleeve used in the present embodiment uses SUS304 (stainless steel) having a film thickness of 35 μm as a base layer in order to make temperature rise up to a fixing-capable temperature within a very short time possible. Also, an electrically conductive primer layer having a suitable amount of electrically conducting material such as carbon dispersed therein is applied on the base layer with a film thickness of 5 μm. In order to prevent the adherence of the toner or paper dust and secure the separability of the recording material, a mixed liquid of PTFE and PFA as fluorine resin excellent in mold releasability and high in heat resistance is applied onto the electrically conductive primer layer with a film thickness of 10 μm by a dipping application method and is sintered to thereby form a mold releasing layer, and an SUS sleeve (metallic sleeve) is formed by the base layer, the primer layer and the mold releasing layer.

A lengthwise portion of the primer layer is exposed in the circumferential direction thereof. For the purpose of preventing offset and tailing, the exposed portion is grounded to a main body GND (ground) through a diode 28 as a rectifying element (the direction is set so that the primer layer side may be an anode) so that the surface of the fixing film may not assume plus potential. Thereby, the unfixed toner image on the recording material is prevented from shifting to the fixing film.

The reference numeral 11 designates a heater as a heating member installed in the interior of the fixing film, and by this heater, the heating of a fixing nip part N for fusing and fixing the unfixed toner image on the recording material is effected. This heating heater 11 (see FIG. 5) has a ceramic substrate 11*a* made of alumina (Al 203) and having high insulativeness, and an energized heat-generating resistor layer 11*b*. The energized heat-generating resistor layer 11*b* is silver palladium (Ag/Pd) formed on the ceramic substrate 11*a* by a method such as screen printing, and has a thickness of the order of 10 μm and a width of the order of 4 mm, and is applied in the shape of a thin band along the lengthwise direction of the ceramic substrate.

On the back of the ceramic substrate 11*a*, a thermistor 14 as a temperature detecting element for detecting the temperature of the ceramic substrate 11*a* having risen in temperature in conformity with the heat generation of the energized heat-generating resistor layer 11*b* is disposed substantially centrally of a recording material passing area. In conformity with a signal from this thermistor 14, a voltage applied from an electrode portion formed of an alloy (Ag/Pt) of silver and platinum on a lengthwise end portion of the energized heat-generating resistor layer 11*b* to the energized heat-generating resistor layer 11*b* through a conducting portion formed on an end portion of the energized heat-generating resistor layer 11*b* is appropriately controlled, whereby the temperature in the heater 11 in the fixing nip is kept substantially constant at a predetermined controlled temperature, and heating necessary to fix the unfixed toner image on the recording material is effected.

As a method of controlling the electrical energization of the energized heat-generating resistor layer, there is applied a wave number controlling method of controlling energizing electric power by the wave number of an AC voltage, or a phase controlling method of electrically energizing till the next zero cross after a predetermined delay time from the zero cross of an AC voltage.

Also, a protective layer comprising a thin-layer glass coat capable of withstanding the frictional sliding relative to the fixing film is provided on that surface of the heating heater which is adjacent to the fixing nip.

The reference numeral 12 denotes a heater holder as a holding member, and it is an adiabatic heater holder for holding the heating heater 11 and preventing radiation toward the opposite side of the fixing nip part N. This heater holder 12 is formed of a liquid crystal polymer, phenol resin, PPS, PEEK or the like. The fixing film 13 is loosely fitted around this heater holder 12 and is disposed for rotation in the direction of arrow. In the present embodiment, the heater holder 12 is an adiabatic heater holder made of a liquid crystal polymer.

Also, the fixing film 13 is rotated while frictionally sliding relative to the heating heater 11 therein and the adiabatic heater holder 12 and therefore, it is necessary to suppress the frictional resistance between the heating heater 11 and the fixing film 13 and between the adiabatic heater holder 12 and the fixing film 13 to a small level. For this purpose, a small amount of heat-resistant grease as a lubricant is applied to the surfaces of the heating heater 11 and the adiabatic heater holder 12. Thus, the fixing film 13 becomes smoothly rotatable. A member for regulating the lengthwise position of the fixing film 13 is positioned by a flange 17. For a member used as this flange 17, glass fiber containing resin such as PPS, a liquid crystal polymer, PET, PI or PA is used as a material relatively not good in thermal conductivity and excellent in slidability.

Figure 4A:
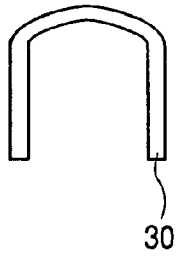
FIGS. 4A, 4B and 4C are cross-sectional views of a reinforcing member in the heat-fixing apparatus.
Figure 4B:
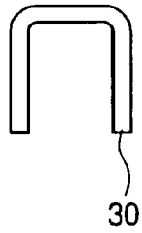
Figure 4C:
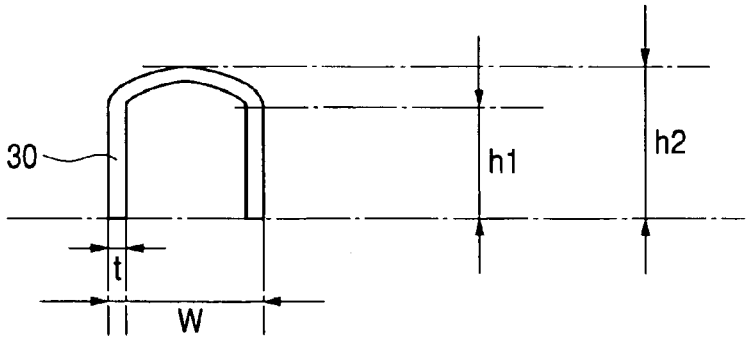
Figure 5:
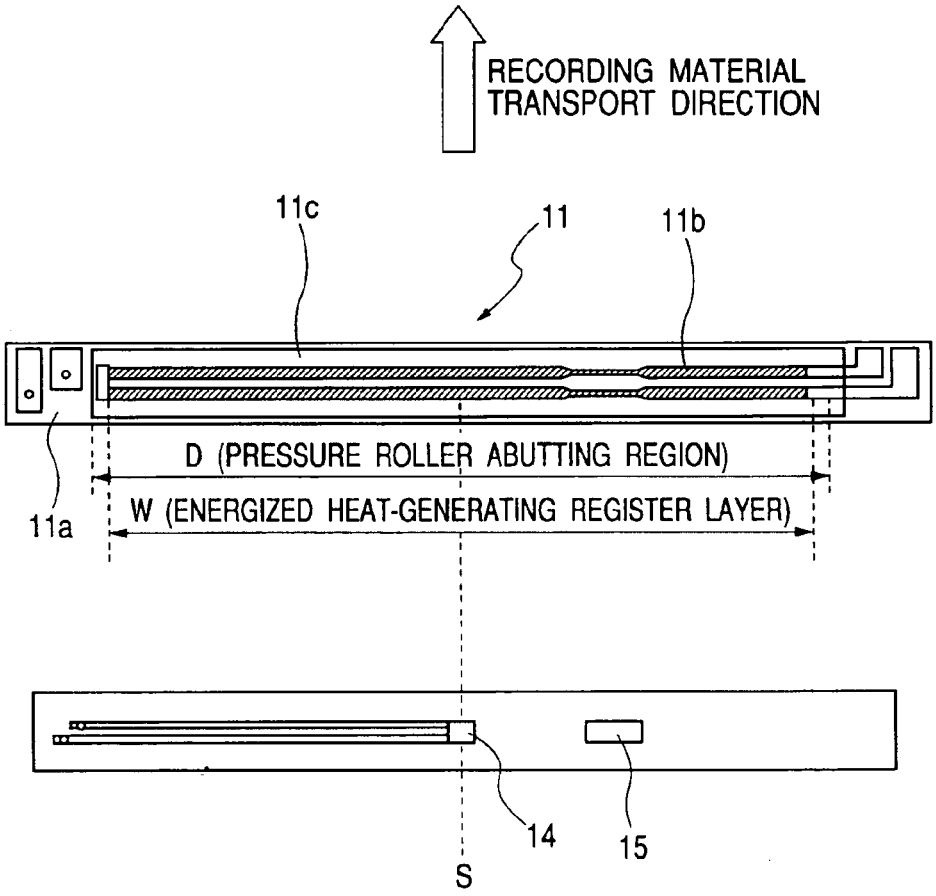
FIG. 5 is a schematic view showing the nip side surface and reinforcing member side surface of a heating heater.

A metallic reinforcing member 30 abuts against the counter-heater side of the heater holder 12 by which the ceramic heater 11 which is a heating member is held, whereby the heater holder 12 is prevented from being flexed by a pressure force applied to between the fixing film unit 10 and a pressure member 20, whereby the formation of a desired fixing nip part N is achieved. For the metallic reinforcing member 30, iron, aluminum or the like is generally used as a metal which is inexpensive and high in machinability as well as excellent in strength. The shape of the reinforcing member 30 assumes an arch-like cross-sectional shape such as a "lateral U-shape" or a "U-shape" in order to be excellent in strength, make heat capacity small, and include therein a thermistor which is a temperature detecting element and a thermoswitch which is a safety element. The thermistor and the thermoswitch abut against the heater through a hole formed in the heater holder 12. Thus, these elements are surrounded by the reinforcing member. The cross-sectional shape of the reinforcing member is an "inverted U-shape" as shown in FIG. 4A, or a "U-shape" as shown in FIG. 4B. Also, the material of the metallic reinforcing member 30 is a ZINKOTE steel sheet, and the construction thereof is such that as shown in FIG. 4C, the thickness "t" is 1.6 mm, the height "h1" is 10 mm, the height "h2" is 15 mm and the width "W" is 16 mm.

<<Pressure Member>>

The reference numeral 20 designates a pressure roller as a pressure member (backup member), and it comprises a mandrel 21 and an elastic layer 22 formed on the outer side thereof by heat-resistant rubber such as silicon rubber or fluorine rubber or by silicon rubber being foamed, and a mold releasing layer 33 of PFA, PTFE, FEP or the like may be formed thereon. The pressure roller 20 is pressed against the fixing film 13 with total pressure of 147 N by a pressing spring as pressing means, and forms a fixing nip part N between it and the fixing film 13, with a width of about 6 mm in the direction of movement of the fixing film. The pressure roller 20 used in the present embodiment is of the following construction.

The pressure roller in the present embodiment comprises an aluminum mandrel having a diameter of 15 mm, and heat-resistant insulative silicon sponge rubber formed with a thickness of 5 mm thereon, and further a PFA tube having a thickness of 50 $\mu$m and having dispersed therein 10 and several % by weight ratio of carbon which is an electrically conducting material, and covering the silicon sponge rubber. By such a construction, the pressure roller 20 is a pressure roller having hardness of about 54° (a load of 9.8 N) in terms of Asker-C hardness.

On this pressure roller 20, in order to provide a potential difference between it and the fixing film 13 for the purpose of preventing offset, a diode 28 is also installed between the pressure mandrel 21 and the main body GND so that the pressure mandrel side may be a cathode and the main body GND side may be an anode. Thereby there is provided such a construction in which the surface of the pressure roller assumes plus potential and a potential difference for preventing offset is formed between the pressure roller and the fixing film 13.

Also, a rotative driving force from a rotative drive transmitting system, not shown, is applied to a pressure roller driving gear 26, and the pressure roller 20 is rotatively driven in the direction of arrow. Thus, the above-described fixing film 13 is driven to rotate outside the heater holder 12.

In the above-described construction of the heat-fixing apparatus, the recording material P on which a toner image has been formed in the image forming portion is guided by a fixing entrance guide 27 and is transported to the fixing nip part N formed by the fixing film 13 and the pressure roller 20, and is heated and pressurized, whereby the unfixed toner image T on the recording material P is fixed as a permanent image on the recording material P. A delivery sensor 76 is a sensor for judging whether the recording material P is present in the fixing nip part N, and outputs a signal used to control the electrical energization of the heating member.

<<Diameter of the Fixing Film and Shape of the Reinforcing Member>>

Description will now be made in detail about the diameter of the fixing film 13 (the metallic sleeve in the present embodiment), the shape of the reinforcing member 30 and the distance between the fixing film and the reinforcing member.

Figure 2:
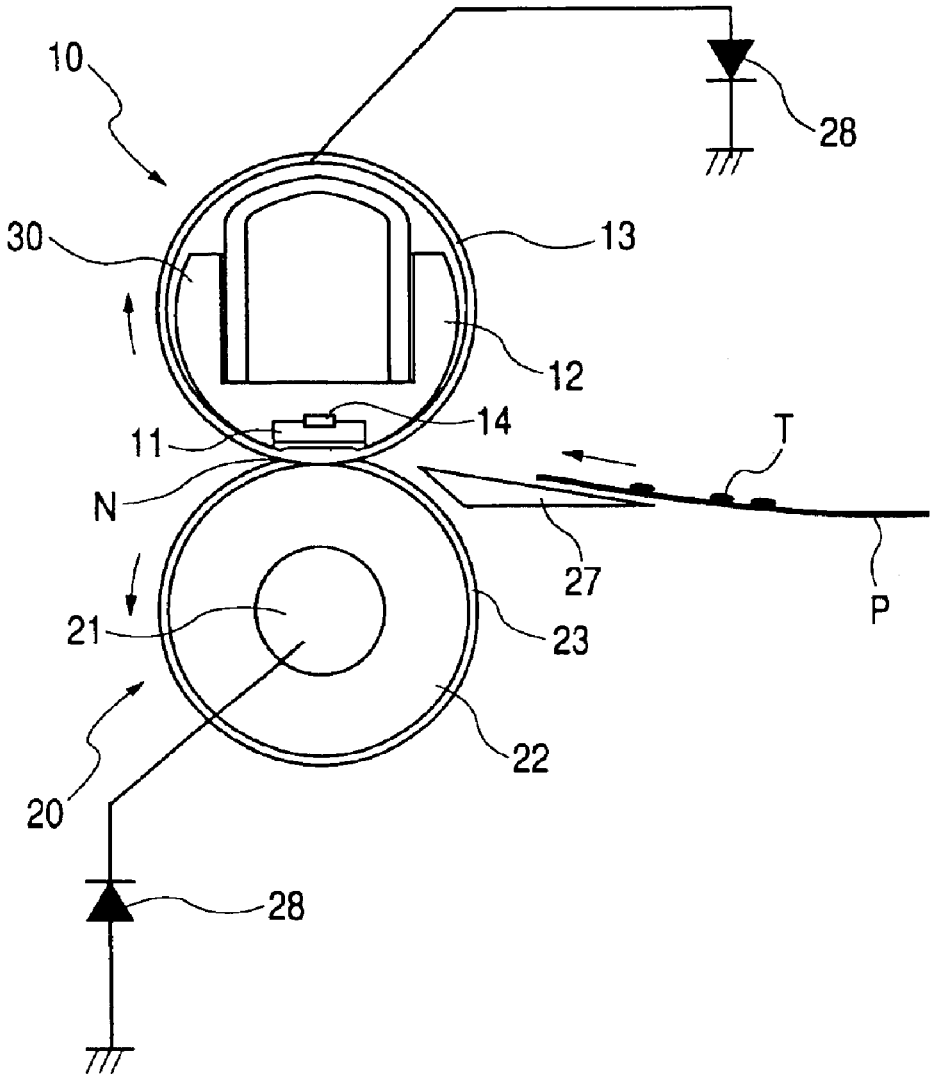
FIG. 2 is a cross-sectional view of the heat-fixing apparatus which provides reference to understand the present invention.
Figure 3:
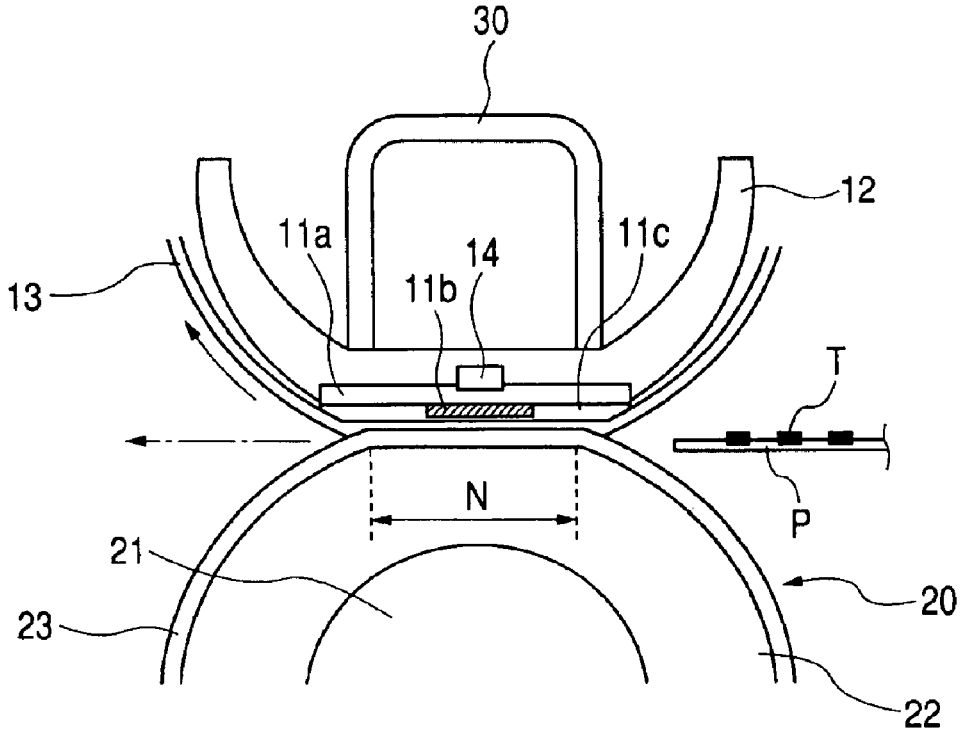
FIG. 3 is an enlarged cross-sectional view of the surroundings of the fixing nip part of the heat-fixing apparatus of FIG. 2.

First, the fixing when the inner diameter of the fixing film 13 was selected to $\phi30/\phi28/\phi27/\phi26.5/\phi26/\phi24$ mm and the relation between the temperature of the fixing film 13 and the temperature of the metallic reinforcing member 30 were confirmed. Also, the shape of the metallic reinforcing member 30 was an "inverted U-shaped" cross-sectional shape as shown in FIG. 2 or 3.

The confirmation of fixing was done by the use of rough paper having unevenness on the surface thereof and generally not good in fixing in an image forming apparatus of the electrophotographic type. The basis weight of this rough paper is 90 g/m$^2$, and the size thereof is LTR size. Evaluation was confirmed for continuous supply of 250 sheets under environment low in the atmospheric temperature (17° C.) which was severe to fixing. During this continuous print, the heater is controlled so as to maintain 215° C. In this experiment, the fixing device starts the rotation of the fixing film in 0.5 second after the start of the electrical energization of the heater.

Figure 8:
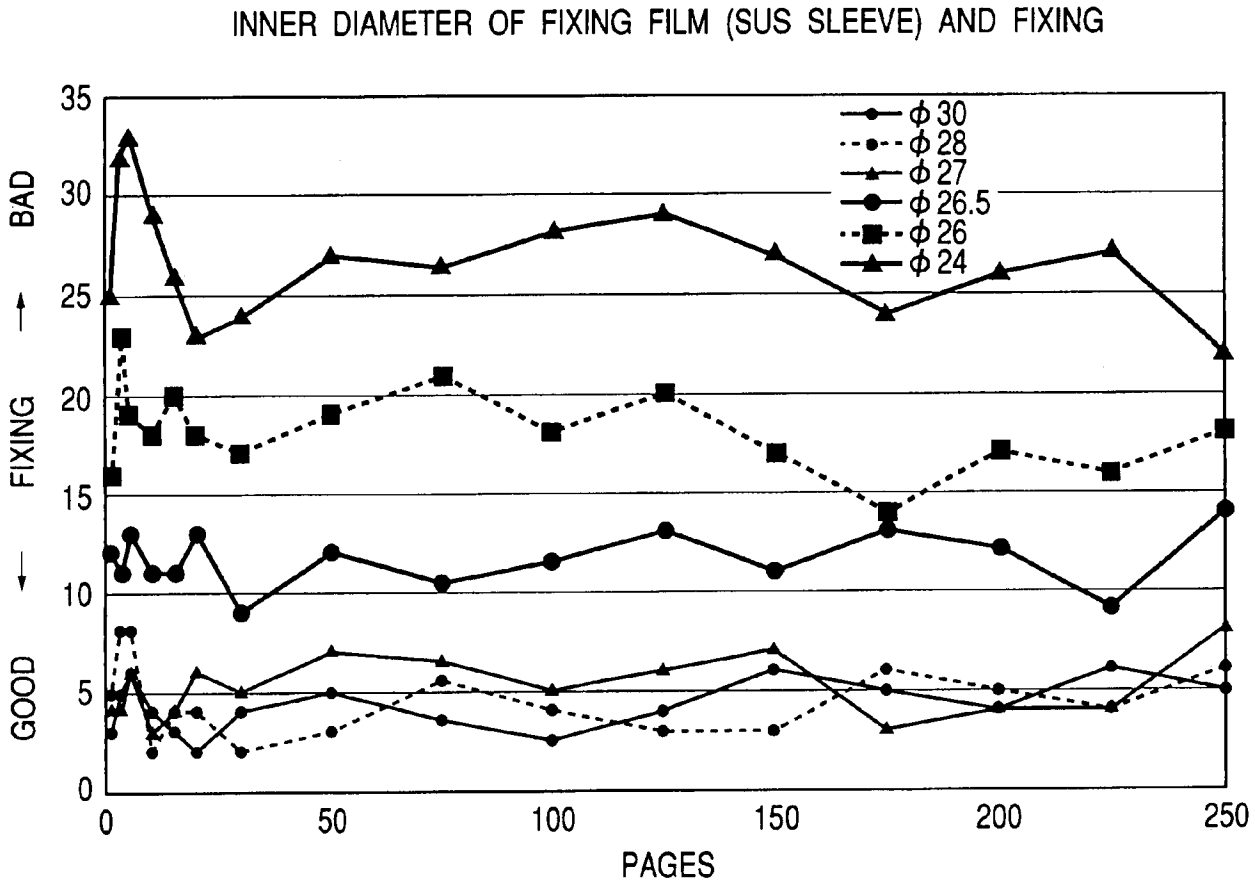
FIG. 8 is a graph showing the relation between the fixing of a toner and the number of continuously printed sheets for each fixing film differing in inner diameter.

The result of the confirmation of fixing is shown in FIG. 8. FIG. 8 shows the number of continuously printed sheets on the axis of abscissa, and the fixing on the axis of ordinate. As shown in FIG. 8, it will be seen that in the "inverted U-shaped" reinforcing member 30 used in this study, good fixing is obtained if the inner diameter of the fixing film 13 is $\phi27$ mm or greater. It will also be seen that as the inner diameter of the fixing film 13 becomes smaller, the fixing becomes worse.

Figure 1:
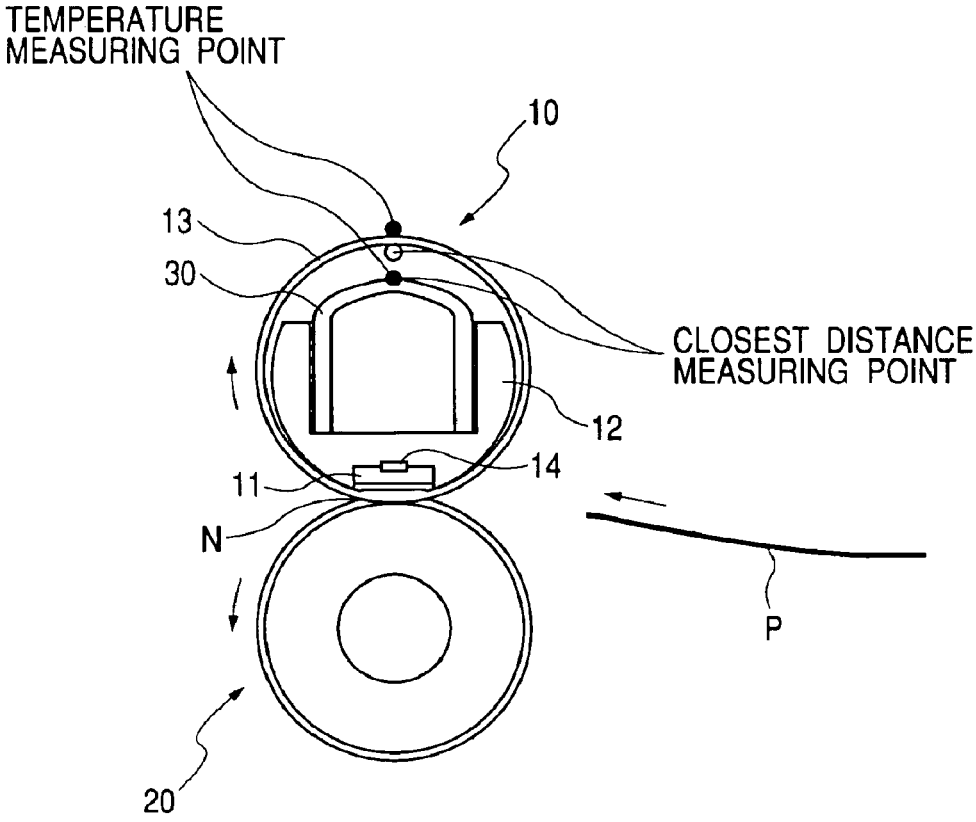
FIG. 1 is a cross-sectional view of a heat-fixing apparatus according to a first embodiment of the present invention.
Figure 9:
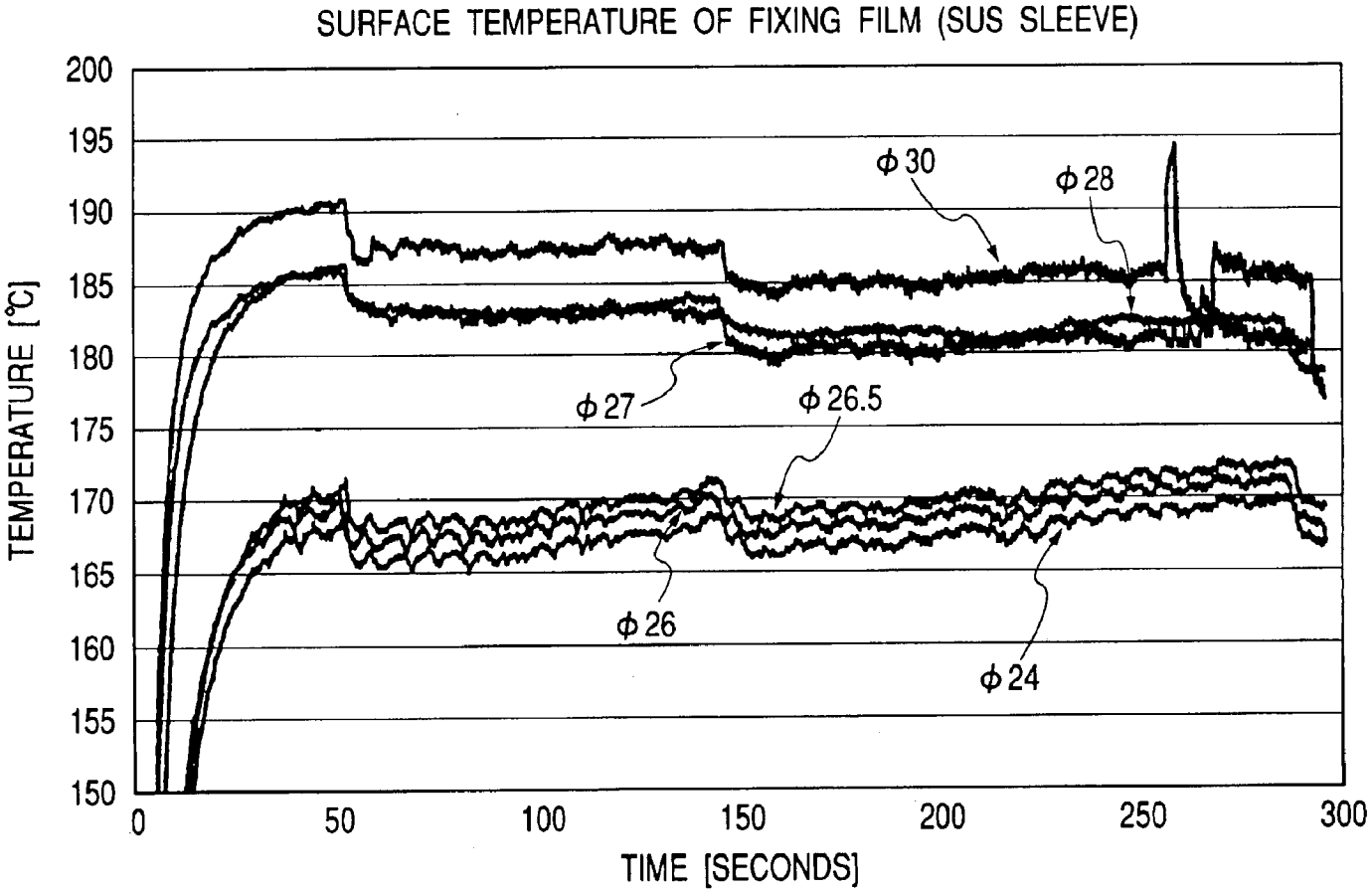
FIG. 9 is a graph showing the relation between the surface temperature of fixing film and the continuously printing time for each fixing film differing in inner diameter.
Figure 10:
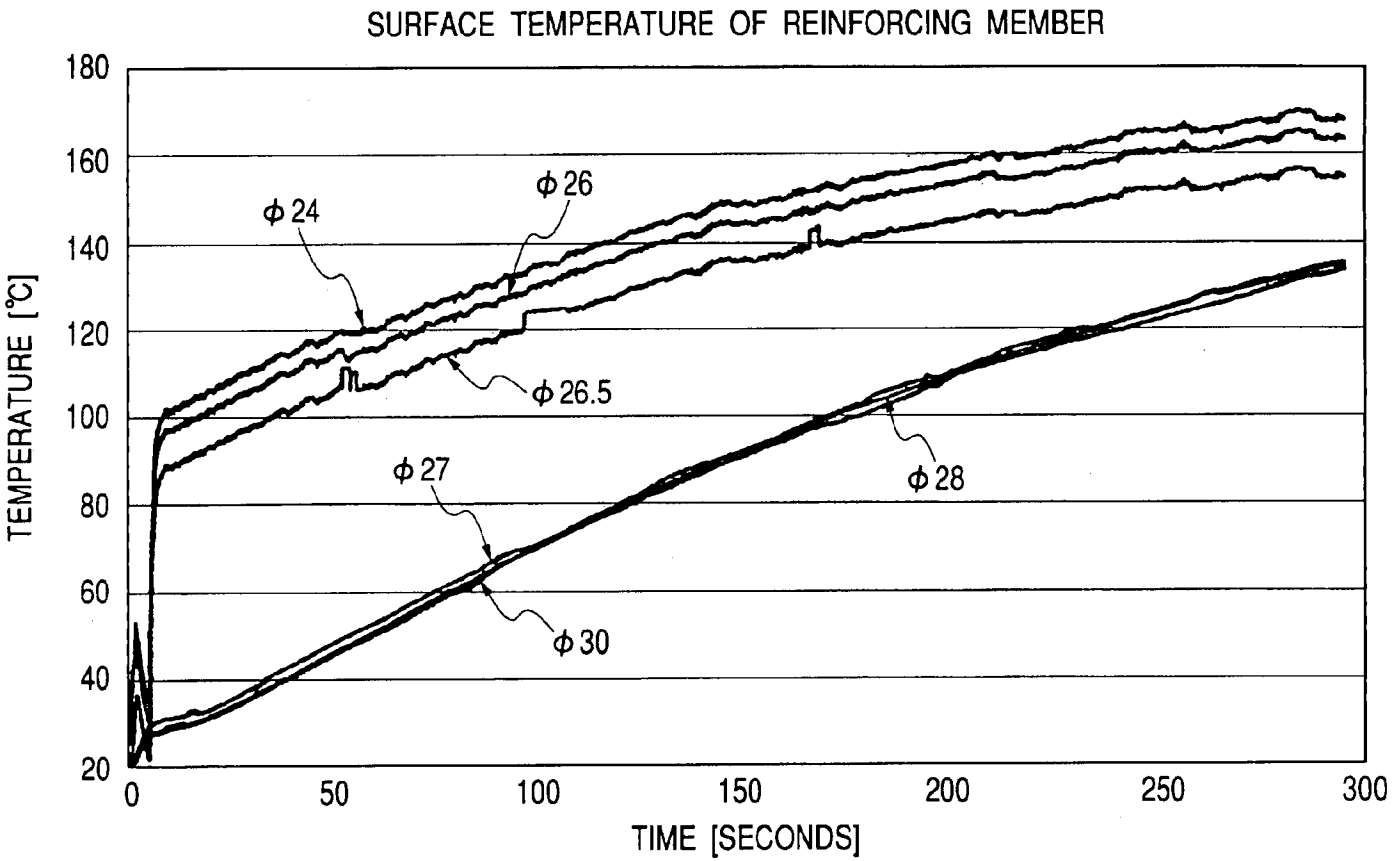
FIG. 10 is a graph showing the relation between the surface temperature of the reinforcing member and the continuously printing time for each fixing film differing in inner diameter.

In order to confirm a factor for this, the result of the measurement of the surface temperatures of the fixing film (SUS sleeve) 13 and the metallic reinforcing member 30 effected at a temperature measuring point indicated in FIG. 1, i.e., a point at which the fixing film and the reinforcing member are closest to each other, is shown in FIGS. 9 and 10. In both of FIGS. 9 and 10, the axis of abscissa shows the time elapsed after the start of the operation of the fixing device, and the axis of ordinate shows the temperature at the measuring point. As will be seen from these figures, when fixing film 13 having an inner diameter of ϕ27 mm or greater is used, there is a temperature difference of about 40° C. or greater between the temperature of the reinforcing member 30 and the temperature of the fixing film 13, but the temperature difference is about 15° C. for ϕ26.5 mm, and is about 7° C. for ϕ26 mm, and the temperatures of the two are substantially the same for ϕ24 mm, and it has been found that as the inner diameter of the fixing film 13 becomes smaller of the fixing film 13 becomes smaller, the temperature difference between the fixing film 13 and the reinforcing member 30 becomes smaller.

This is attributable to the excellent radiative property which is the characteristic of the metal. The reason will hereinafter be described. The heat of the heater 11 which is a heat source is transferred to the heater holder 12, and is further transferred to the metallic reinforcing member 30, whereby the metallic reinforcing member 30 rises to a certain constant temperature. The saturation temperature at which this temperature rise settles is, in the heat-fixing apparatus used in the present embodiment, about 130–135° C. which is the temperature of the metallic reinforcing member 30 when use is made of the aforedescribed fixing film 13 having an inner diameter of ϕ27 mm or greater. The reason why the metallic reinforcing member 30 does not rise to a temperature higher than this temperature is that the air intervening between the fixing film 13 and the metallic reinforcing member 30 which are in non-contact with each other acts as an adiabatic material.

On the other hand, when the inner diameter of the fixing film 13 is small, the closest distance between the fixing film 13 and the metallic reinforcing member 30 becomes small and the air intervening therebetween comes not to act as an adiabatic material, and heat energy radiated from the fixing film 13 is transferred through the air to thereby cause the temperature rise of the metallic reinforcing member 30. Therefore, the radiation from the fixing film 13 is great and the temperature of the fixing film 13 is lowered. The heat energy corresponding to the amount of lowering of the temperature of this fixing film 13 is transmitted through the air to thereby cause the temperature rise of the metallic reinforcing member 30. Therefore, when the closest distance between the fixing film 13 and the metallic reinforcing member 30 was the smallest ϕ24 mm, the temperature of the fixing film 13 and the temperature of the metallic reinforcing member 30 became substantially the same temperatures.

In Table 1 below, there are shown the closest distance (mm) between the fixing film 13 and the metallic reinforcing member 30, and the saturated temperatures (° C.) of the fixing film 13 and the metallic reinforcing member 30 during the continuous supply of paper, when the inner diameter of the fixing film (metallic sleeve) 13 was selected to the above-mentioned values. The closest distance was measured at the closest distance measuring point indicated in FIG. 1. Also, there is shown the rate of the temperatures of the fixing film 13 and the metallic reinforcing member 30. As shown in the table, it will be seen that when the closest distance between the fixing film 13 and the metallic reinforcing member 30 becomes below about 2.0 mm, the temperature difference between the fixing film 13 and the metallic reinforcing member 30 becomes small and the ratio therebetween is over the order of 75%.

TABLE 1

| | Closest Distance | SUS Sleeve Temperature Ts | Metallic Reinforcing Member Temperature Tb | Tb/Ts |
|---|---|---|---|---|
| ϕ 24 | 0.7 | about 170 | about 168 | 98.8 |
| ϕ 26 | 1.6 | about 171 | about 164 | 95.9 |
| ϕ 26.5 | 1.9 | about 172 | about 160 | 93.0 |
| ϕ 27 | 2.3 | about 181 | about 135 | 74.6 |
| ϕ 28 | 3.4 | about 182 | about 134 | 73.6 |
| ϕ 30 | 4.5 | about 185 | about 133 | 71.9 |

As has hitherto been described, when the closest distance between the fixing film 13 and the metallic reinforcing member 30 becomes small, there occurs a flow of heat from the fixing film 13 to the metallic reinforcing member 30, and this leads to the aggravation of fixing with the lowering of the surface temperature of the fixing film. As a result of detailed studies, it has been found that when the temperature of the reinforcing member becomes higher than 80% of the temperature of the fixing film, it leads to the aggravation of fixing. Accordingly, it has been found that it is necessary to set the distance between the fixing film and the reinforcing member so that the temperature of the reinforcing member may become 80% or less of the temperature of the fixing film. It has also been found that to suppress the temperature of the reinforcing member to 80% or less of the temperature of the fixing film even if continuous print is effected, the distance between the portions of the two which are closest to each other can be 2.0 mm or greater.

While in the previous description, the inner diameter of the fixing film 13 has been a certain predetermined value or greater (ϕ27 mm or greater so that the ratio between the surface temperature of the fixing film and the temperature of the metallic reinforcing member may be 80% or less, preferably below about 75%, in other words, in order that the closest distance between the fixing film and the reinforcing member may be a certain predetermined value or greater (2.0 mm or greater), description will now be made of a case where the inner diameter of the fixing film 13 is ϕ30 mm and the shape or size of the metallic reinforcing member 30 is changed to thereby vary the closest distance. As regards evaluation, the evaluation of insulativeness similar to what has been previously described, the surface temperature of the fixing film and the temperature of the metallic reinforcing member was carried out. The size of the metallic reinforcing member was confirmed at five levels in total, i.e., three levels for the size with the previously used cross-sectional shape unchanged, and two levels with the "U-shape" used as the cross-sectional shape. The construction of each metallic reinforcing member is such that the material thereof is a ZINKOTE Steel Sheet, the thickness "t" thereof is 1.6 mm, the height "h2" thereof is 15 mm for "small" in Table 2 below, 16.5 mm for "medium", and 18.2 mm for "great". The result of the evaluation is shown in Table 2 below.

TABLE 2

| | Closest Distance | Fixing | SUS Sleeve Surface Temperature (° C.) Ts | Metallic Reinforcing Member Temperatures (° C.) Tb | Tb/Ts |
|---|---|---|---|---|---|
| Inverted U-shape Small | 4.5 | ○ | about 185 | about 133 | 71.9 |
| Inverted U-shape Medium | 2.8 | ○ | about 183 | about 136 | 74.3 |
| Inverted U-shape Great | 1.3 | X | about 169 | about 164 | 97.0 |
| U-shape Small | 4.6 | ○ | about 187 | about 132 | 70.6 |
| U-shape Great | 1.6 | X | about 172 | about 159 | 92.4 |

As shown in Table 2, it will be seen that a construction good in fixing is such that the temperature ratio (Tb/Ts) between the surface temperature of the fixing film and the surface temperature of the metallic reinforcing member is about 70%, and at least 80% or less. Regarding the correlation between this temperature ratio and the closest distance between the fixing film and the reinforcing member, there was obtained a result similar to that when the aforedescribed inner diameters of the fixing film were selected. The reason for this is as described previously.

From what has been described above, it has been found that if design is made such that the closest distance between the fixing film 13 and the metallic reinforcing member 30 is provided so that when a number of recording materials are to be continuously printed, the temperature ratio between the surface temperature of the fixing film 13 and the surface temperature of the metallic reinforcing member 30 may be 80% or less, that is, so that the surface temperature of the reinforcing member 30 may be saturated at a temperature of 80% or less of the surface temperature of the fixing film 13, there can be provided the construction of a heat-fixing apparatus which will always obtained good fixing even when use is made of fixing film 13 formed of a metal excellent in radiative property.

In the foregoing, regarding the construction of a heat-fixing apparatus using fixing film formed of a metal, wherein in order to obtain good fixing at all times, the temperature of the metallic reinforcing member 30 is 80% or less of the temperature of the fixing film 13, description has been made of a case where the inner diameter of the fixing film 13 and the size of the metallic reinforcing member 30 were selected as previously described, but to efficiently use the generated heat energy from the heater which is a heat source to thereby achieve energy saving, it becomes requisite to make the entire heat-fixing apparatus as small as possible and therefore, it is desirable for the size of the metallic reinforcing member 30 to be as small as possible. However, between the metallic reinforcing member 30 and the heater holder 12, as already described, there is the necessity of installing the thermistor 14 which is a temperature detecting element and the thermoprotector 15 which is a safety element such as a thermoswitch, and the necessity of keeping the strength as the reinforcing member 30, and therefore the size of the metallic reinforcing member 30 is limited.

So, rather than the size of the metallic reinforcing member 30, it is preferable to select fixing film 30 of the smallest inner diameter from among various types of fixing film 13 for which the temperature of the metallic reinforcing member 30 as described above is 80% or less of the surface temperature of the fixing film 13.

As has hitherto been described, according to the present embodiment, it becomes possible to construct a heat-fixing apparatus using as fixing film a metallic sleeve excellent in thermal conductivity and capable of achieving a higher speed and energy saving, wherein if the closest distance between the fixing film 13 and the reinforcing member 30 is designed such that the temperature of the metallic reinforcing member 30 is saturated at 80% or less of the surface temperature of the fixing film 13, it becomes difficult for the heat energy transferred from the heater 11 to the fixing film 13 to be transferred to the reinforcing member 30, and this heat energy is efficiently transferred to the recording material and therefore, even if an improvement in thermal efficiency by the smaller diameter of the fixing film 13 is contrived, it becomes possible to always obtain good fixing without spoiling fixing, and the quality of image is not spoiled. Also, the temperature rise of the reinforcing member can be suppressed and therefore, the malfunctioning of the safety element surrounded by the reinforcing member can also be suppressed.

[Second Embodiment]

A second embodiment of the present invention will now be described. The second embodiment, as shown in FIG. 11, is of a construction in which an adiabatic member 31 is provided on that surface side of the metallic reinforcing member 30 which is adjacent to the fixing film, and only the difference of the second embodiment from the aforedescribed first embodiment will hereinafter be described, and portions similar to those of the aforedescribed first embodiment need not be described.

The aforedescribed first embodiment is an embodiment of the present invention in which because the radiated heat from the fixing film 13 is transferred through the air layer between it and the reinforcing member 30 which is in non-contact therewith to thereby cause the temperature rise of the metallic reinforcing member 30, the closest distance between the fixing film 13 and the metallic reinforcing member 30 is provided so that the surface temperature of the metallic reinforcing member 30 may become a temperature of 80% or less of the surface temperature of the fixing film 13. This is attributable to the fact that the fixing film 13 formed of a metal is excellent in a radiative property peculiar to the metal, but when viewed from the metallic reinforcing member 30 side, the characteristic peculiar to the metal which is readily liable to rise in temperature also greatly contributes to it.

Figure 11:
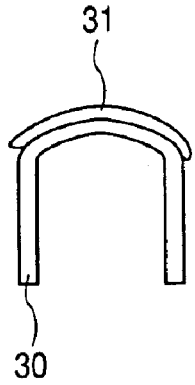
FIG. 11 is an illustration of a reinforcing member having an adiabatic layer according to a second embodiment of the present invention.

So, in the second embodiment, in order to prevent the ready rise in temperature which is the characteristic of the metal, as shown in FIG. 11, the adiabatic member 31 made of resin is provided on that surface side of the metallic reinforcing member 30 which is adjacent to the fixing film, whereby it is made difficult for the heat energy transferred from the fixing film 13 through the air layer to be transferred to the metallic reinforcing member 30, thereby suppressing the radiation from the fixing film 13 to a small level. That is, the second embodiment is of a construction in which the adiabatic member 31 is provided on that surface side of the reinforcing member 30 which is adjacent to the fixing film 13 so that the surface temperature of the reinforcing member 30 may become a temperature of 80% or less of the surface temperature of the fixing film 13.

As a resin material having an adiabatic property, use was made of SUMIKSUPER produced by Sumitomo Kagaku Kogyo Co., Ltd. SUMIKASUPER is resin having a number of very minute spherical cells in liquid crystal polymer (LCP) and having excellent features such as a high adiabatic property and high temperature-resistance. The adiabatic member formed of this material has a thickness of 1.2 mm and was installed so as to cover the upper surface side of the metallic reinforcing member 30. Table 3 below shows the result of the measurement of fixing carried out when use was made of the metallic reinforcing member 30 having the above-described adiabatic layer (adiabatic member 31) and the inner diameter of the fixing film 13 was selected to ϕ28, ϕ27, ϕ26.5 and ϕ26 mm, the result of the measurement of the surface temperatures (° C.) of the fixing film 13 and the adiabatic member 31, and the temperature ratio therebetween. For the evaluation of fixing, the measurement of the temperatures, etc., use was made of a technique similar to that in the aforedescribed first embodiment.

TABLE 3

| SUS Sleeve Inner Diameter | Fixing | SUS Sleeve Surface Temperature | Adiabatic Member Surface Temperature | Tb/Ts |
|---|---|---|---|---|
| ϕ 26 | X | about 172 | about 164 | 95.3 |
| ϕ 26.5 | ○ | about 182 | about 132 | 72.5 |
| ϕ 27 | ○ | about 183 | about 124 | 67.8 |
| ϕ 28 | ○ | about 185 | about 128 | 69.2 |

As described above, the adiabatic member 31 made of resin as a member having a high adiabatic property is provided on that surface side of the metallic reinforcing member 30 which is adjacent to the fixing film so that the surface temperature of the reinforcing member 30 may become a temperature of 80% or less of the surface temperature of the fixing film 13, whereby it becomes difficult for the heat energy radiated from the fixing film 13 to be transferred to the metallic reinforcing member 30 through the air layer and therefore, there can be provided a heat-fixing apparatus which does not spoil fixing even if the inner diameter of the fixing film 13 is made small as compared with that in the aforedescribed first embodiment.

While in the present embodiment, resin having a high adiabatic property and high temperature-resistance is used as the adiabatic member, of course, a construction in which other adiabatic material, e.g. glass wool or the like is suitably stuck on the reinforcing member is also effective to prevent the lowering of the surface temperature of the fixing film during continuous supply of paper by the adiabatic property thereof.

As has hitherto been described, according to the present embodiment, it becomes possible to construct a heat-fixing apparatus using as fixing film a metallic sleeve excellent in thermal conductivity and capable of achieving a higher speed and energy saving, wherein the adiabatic member 31 is provided on that surface side of the reinforcing member 30 which is adjacent to the fixing film so that the temperature of the metallic reinforcing member 30 may become 80% or less of the surface temperature of the fixing film 13, whereby it becomes difficult for the heat energy transferred from the heater 11 to the fixing film 13 to be transferred to the reinforcing member 30, and the heat energy is efficiently transferred to the recording material and therefore, even if an improvement in thermal efficiency by the smaller diameter of the fixing film 13 is contrived, it becomes possible to always obtain good fixing without spoiling the fixing and the quality of image is not spoiled.

[Other Embodiments]

While in the aforedescribed embodiments, an image forming apparatus capable of forming apparatus capable of forming monochromatic images has been shown by way of example, the present invention is not restricted thereto, but may be an image forming apparatus capable of forming color images, and a similar effect can be obtained by applying the present invention to a fixing apparatus in the image forming apparatus.

Also, while in the aforedescribed embodiments, a printer has been shown by way of example as an image forming apparatus, the present invention is not restricted thereto, but may be other image forming apparatus such as a copying machine or a facsimile apparatus, or other image forming apparatus such as a coplex machine having a combination of the functions thereof, or an image forming apparatus which uses a recording materials which uses a recording material bearing member and superimposes and transfers toner images of respective colors in succession to a recording material borne on the recording material bearing member, or an image forming apparatus which uses an intermediate transferring member and superimposes and transfers toner images of respective colors in succession to the intermediate transferring member, and collectively transfers the toner images borne on the intermediate transferring member to a recording material, and a similar effect can be obtained by applying the present invention to a fixing apparatus in the image forming apparatus.

While various embodiments of the present invention have been shown and described, the gist and scope of the present invention are not restricted to particular description herein and particular drawings.

As described above, according to the present invention, it becomes possible to provide a heat-fixing apparatus in which it becomes difficult for heat energy transferred from a heating member to a rotary member to be transferred to a reinforcing member and the heat energy is efficiently transferred to a recording material and therefore, even if an improvement in thermal efficiency by the smaller diameter of the rotary member is contrived, fixing is not spoiled and it becomes possible to always obtain good fixing and the quality of image is not spoiled.

What is claimed is:

1. An image heating apparatus for heating an image formed on a recording material, comprising:

a metallic sleeve;

a heater contacting with the inner surface of said sleeve;

a temperature detecting element for detecting a temperature of said heater;

control means for controlling an electrical power supply to said heater so that the temperature detected by said temperature detecting element is maintained at a set temperature;

a backup member cooperating with said heater through said sleeve to form a nip for nipping and transporting the recording material; and a metallic reinforcing member disposed in an interior of said sleeve, wherein during a heating operation of heating the recording material by said heater, a surface temperature of said reinforcing member is 80% or less of a surface temperature of said sleeve.

2. An image heating apparatus according to claim 1, further comprising a holding member made of resin for holding said heater, wherein said reinforcing member reinforces said holding member.

3. An image heating apparatus according to claim 2, wherein said reinforcing member is provided parallel to a lengthwise direction of said heater.

4. An image heating apparatus according to claim 3, wherein said reinforcing member has an arch-shaped cross section, and is disposed so that an open side of the arch is opposed to said heater side, and said reinforcing member surrounds a safety element for preventing an excessive temperature rise of said heater.

5. An image heating apparatus according to claim 1, wherein a distance between portions of said sleeve and said reinforcing member which are closest to each other is 2.0 mm or greater.

6. An image heating apparatus according to claim 1, wherein an adiabatic member is provided on a surface of said reinforcing member which is opposed to said sleeve.

7. An image heating apparatus according to claim 1, wherein said sleeve has flexibility.

* * * * *

UNITED STATES PATENT AND TRADEMARK OFFICE

CERTIFICATE OF CORRECTION

PATENT NO. : 6,895,207 B2
DATED : May 17, 2005
INVENTOR(S) : Hiroshi Kataoka et al.

It is certified that error appears in the above-identified patent and that said Letters Patent is hereby corrected as shown below:

Column 1,
Line 29, “method” should read -- methods --.

Column 3,
Line 50, “lengthwisely” should read -- lengthwise --.

Column 4,
Line 36, “is” should read -- if --.
Line 50, “to” should read -- and into --.

Column 5,
Line 42, “rein forcing” should read -- reinforcing --.

Column 11,
Line 13, “smaller of the fixing film 13 becomes” should be deleted.
Line 51, “distance” should read -- distances --.

Column 13,
Line 41, “obtained” should read -- obtain --.

Column 16,
Line 15, “materials” should read -- material --.

Signed and Sealed this

Thirteenth Day of September, 2005

JON W. DUDAS
*Director of the United States Patent and Trademark Office*